United States Patent [19]

Seifert

[11] Patent Number: 4,611,766

[45] Date of Patent: Sep. 16, 1986

[54] RETAINER APPARATUS FOR RELEASABLY SECURING A BOWL LINER IN A ROCK CRUSHER

[75] Inventor: Dennis D. Seifert, Oregon City, Oreg.

[73] Assignee: Esco Corporation, Portland, Oreg.

[21] Appl. No.: 748,923

[22] Filed: Jun. 26, 1985

[51] Int. Cl.[4] ..... B02C 2/00

[52] U.S. Cl. ..... 241/207; 241/285 R; 403/409.1

[58] Field of Search ..... 241/207-216, 241/285 R, 285 A; 403/409, 374, 324

[56] References Cited

U.S. PATENT DOCUMENTS

| | | | |
|---|---|---|---|
| 3,281,083 | 10/1966 | Johnson | 241/208 |
| 3,834,633 | 9/1974 | Dougall et al. | 241/207 X |
| 4,215,826 | 8/1980 | Schäfer | 241/207 |

FOREIGN PATENT DOCUMENTS

| | | | |
|---|---|---|---|
| 1551338 | 8/1979 | United Kingdom | 403/409 |
| 304975 | 3/1972 | U.S.S.R. | 241/209 |

*Primary Examiner*—Howard N. Goldberg
*Assistant Examiner*—Joseph M. Gorski
*Attorney, Agent, or Firm*—Tilton, Fallon, Lungmus & Chestnut

[57] ABSTRACT

Retainer apparatus for releasably securing a generally frusto-conical bowl liner to the bonnet of a rock crusher wherein the generally radially extending loops on the outer surface of the bowl liner are equipped with an upper surface having a curvature extending perpendicular to a radial plane and wherein wedge means includes a wedge and a contoured element having one planar longitudinally extending surface and one arcuate longitudinally extending surface whereby the wedge can be inserted from either side of the loop while still obtaining full surface bearing.

1 Claim, 6 Drawing Figures

RETAINER APPARATUS FOR RELEASABLY SECURING A BOWL LINER IN A ROCK CRUSHER

This application relates to an improved retainer apparatus for releasably securing a bowl liner to the bonnet of a rock crusher and, more particularly, to retainer apparatus which can be inserted from either side of the securing loop while still obtaining full surface bearing.

SUMMARY OF INVENTION

The invention finds particular application to the type of liner described in U.S. Pat. No. 3,281,083. In that patent, the bowl liner is equipped with a number of upstanding lugs which are used in connection with wedges to mount the liner on the crusher bonnet. In the past, if these wedges were installed from the wrong side, the loops could be cracked because of the concentrated bearing load and thereafter an expensive liner was lost.

The instant invention overcomes this serious drawback by virtue of providing a radius on the inside of the loop aperture, the curvature extending in the direction of the wedge to be received within the aperture and a contoured element having one curved longitudinally extending surface and one planar longitudinal surface for cooperating with the wedge in securing the liner securely in place on the bonnet.

Other objects and advantages of the invention may be seen in the details of the ensuing specification.

The invention is described in conjunction with an illustrative embodiment in the accompanying drawing, in which FIG. 1 is a vertical mid-sectional, fragmentary view through a rock crusher of the type depicted in prior art U.S. Pat. No. 3,281,083;

Figure 1:
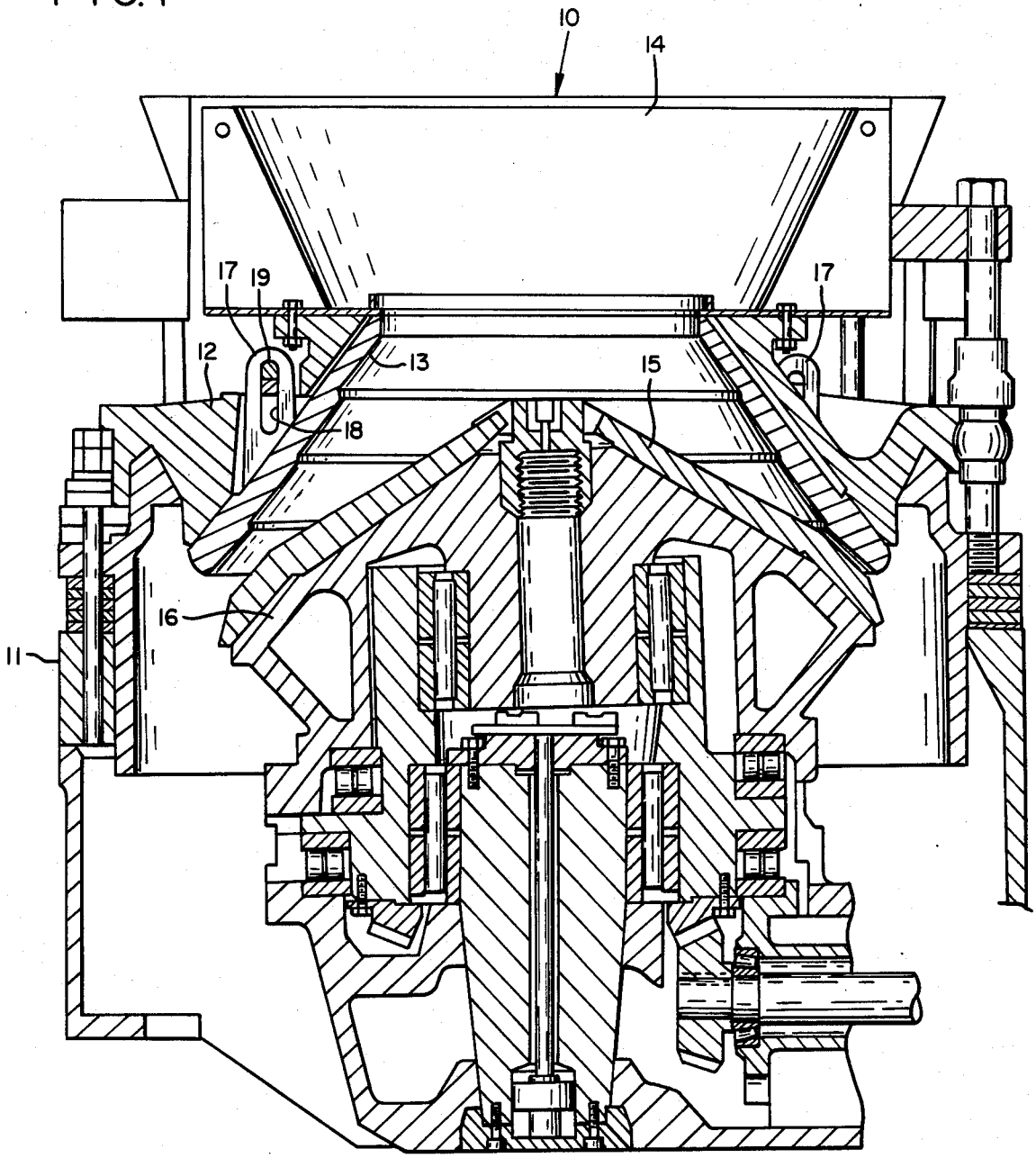

DETAILED DESCRIPTION:

In the illustration given and with reference first to FIG. 1, the numeral 10 designates generally a rock crusher, the important portions of which include a frame 11 for supporting a bonnet 12 to which is affixed a liner 13. This is the stationary portion of the crusher and provides an opening at the top as at 14 for the receipt of rocks to be crushed between the liner 13 and the mantle 15 which is mounted on the rotating crusher head 16. Additional details of the construction and operation of the crusher can be seen in the above mentioned U.S. Pat. No. 3,281,083. The instant invention is particularly concerned with the retainer loops 17—see the upper left and right portions of FIG. 1 which are integral with the liner 13 and project upwardly from the outer surface thereof.

Figure 2:
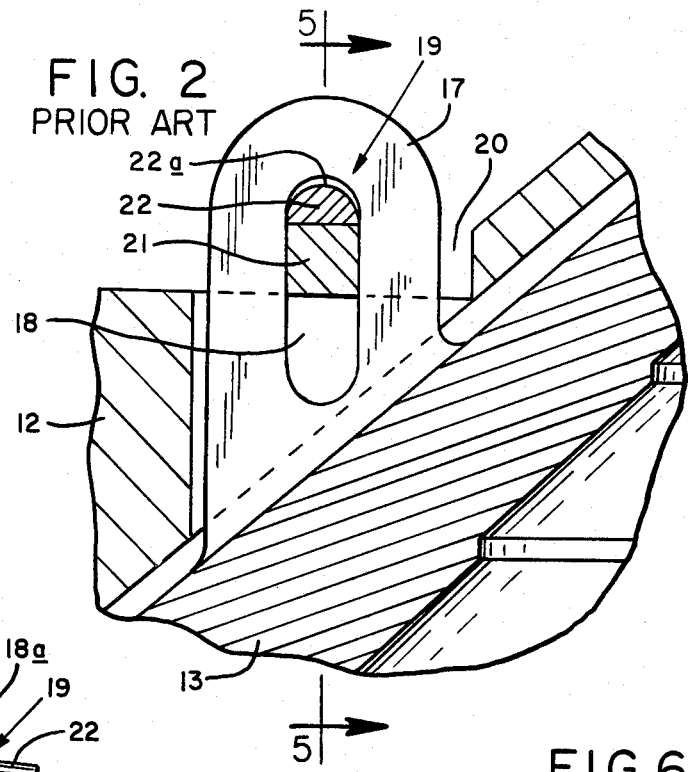
FIG. 2 PRIOR ART
FIG. 2 is an enlarged fragmentary portion of one of the retainer loops of FIG. 1.

The liner 13 is of generally frusto-conical configuration and the lugs or loops 17 thus extend generally parallel to the axis of the liner 13. Normally, a plurality of such loops 17 are provided in equally circumferentially spaced locations on the exterior of the liner 13. Each loop has an aperture 18 for the receipt of wedge means 19 which are used to draw the bowl upwardly against the bonnet 12. This is illustrated in FIG. 2 where the bonnet 12 is seen to be equipped with an opening 20 through which the loop 17 extends. Conventionally a pair of wedge pieces 21 and 22 extend through the aperture 18 across the opening 20—see FIG. 3—to urge the liner upwardly against the interior surface of the bonnet 12. In the instance depicted in FIG. 3, the wedge 21 has been inserted from the wrong side of the loop 17. This has resulted in a localized excessive bearing or stress at the point P which could result in breaking of the loop 17.

Figure 3:
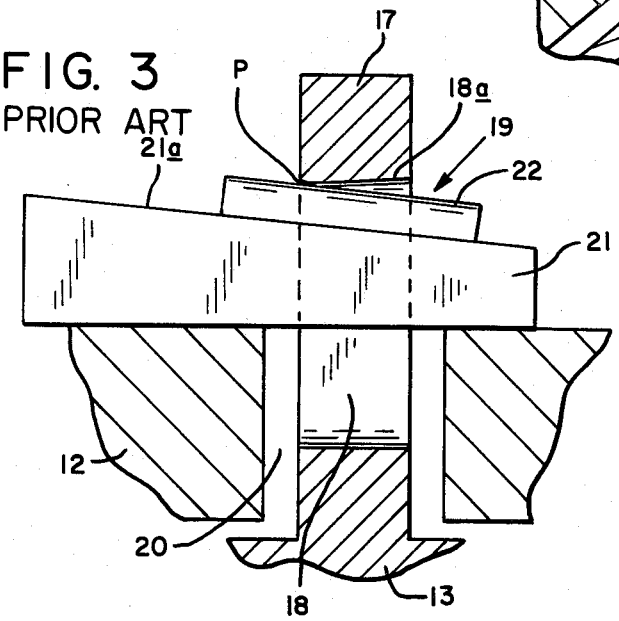
FIG. 3 PRIOR ART
FIG. 3 illustrates the prior art loop of FIG. 2 wherein the wedging means is improperly installed.

Proper installation, in the illustration given in FIG. 3, would have the wedge 21 with its 5° upper wall **21*a* extending in full surface bearing with the 5° inclined upper wall 18*a* of the aperture 18 of the loop 17**.

Figure 4:
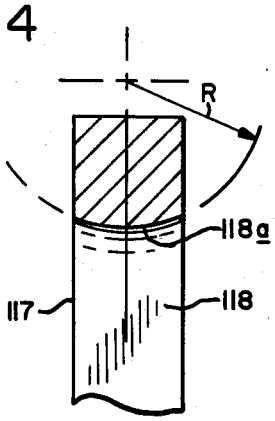
FIG. 4 is a fragmentary, sectional view of a loop modified from the showing in FIG. 3 in accordance with the principles of this invention.
Figure 5:
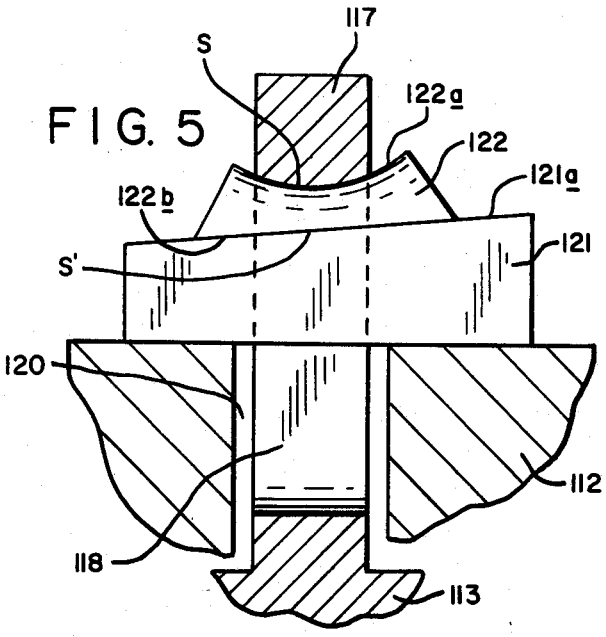
FIG. 5 is a fragmentary view partially in section of the invention and corresponding essentially to the type of view seen in FIG. 3.

The problem of mis-insertion is avoided according to the invention by utilizing a contoured element as at 122—see FIG. 5—in combination with a complementarily contoured upper wall **118*a* of the aperture 118—see FIG. 4. In FIGS. 4 and 5, the same reference numerals are used for like elements as in the preceding views except for the addition of 100**.

Therefore, the wedge is designated 121 and again has a 5° upper wall as at **121*a*. Other angularities may be employed, generally in the range of about 4° to 10° so as to develop sufficient wedging action without having the wedge element being either too long or too short. The lug or loop 117—see FIG. 5—is again equipped with the aperture 118 and projects upwardly from the bowl liner 113. The bonnet is designated 112 and once the lugs 117 are installed within the various openings 120 in the bonnet 112, the wedging means consisting of the wedge 121 and the contoured element 122 are installed as seen in FIG. 5. Thereafter force on the left hand portion of the wedge 121 raises the bowl liner 113 into contact with the bonnet 112—all during which time, there is full bearing contact between the wedging means 121, 122 and the loop 117**, thereby avoiding the development of point or line concentrations of stress which could result in premature rupture or other failure.

In the illustration given, the upper wall **118*a* of the aperture 118 (see FIG. 4) is generated by a radius R extending from a center of curvature above the loop 117. This same radius of curvature is employed to develop the upper contoured surface 122*a* of the contoured element 122. The bottom surface 122*b* of the contoured element 122 is planar so as to provide full surface bearing with the upper surface 121*a* of the wedge 121**. Thus, the inventive arrangement provides a full surface bearing both at S—see FIG. 5 and at S', in studied contrast to the point bearing P seen in FIG. 3 and representative of the prior art.

Figure 6:
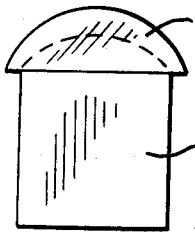
FIG. 6 is an end elevational view of wedging elements employed in conjunction with the showing in FIG. 5.

In the past, the aperture 18—FIG. 2—has been provided in the form of an obround, viz., generally cylindrical top and bottom walls connected by straight sidewalls. Thus, two elements have been used in the past to constitute the wedge means 21 and 22. The upper element of the wedge means has an arcuate upper surface as at **22*a* in FIG. 2. So the aperture was arcuately contoured in a plane extending radially from the axis of the frustoconical bowl liner 13. In the past, however, there has been no provision of an arcuate upper surface in a plane extending transverse to a radius from the liner axis. Therefore, in the illustration given, the upper wall is characterized by curvature in two perpendicularly related directions as can be appreciated from a consideration of FIG. 6. However, it is possible to dispense with the curvature in the radial plane and thus provide a more simply contoured element 122**.

Also, in some instances, the upper wall 118*a* need not be a continuous arc as seen in FIG. 4 but employ planar portions centrally of the length of the arc.

While in the foregoing specification a detailed description of an embodiment of the invention has been set down for the purpose of illustration, many details in the illustration given may be made by those skilled in the art without departing from the spirit and scope of the invention.

I claim:

1. A rock crusher comprising a frame, a bonnet supported on said frame, said bonnet having a plurality of openings, a liner releasably fixed to said bonnet, said liner being generally frusto conical about a vertical axis and having an inner surface and an outer surface, a plurality of integral retainer loops extending upwardly from said liner outer surface and extending through said openings in said bonnet, each loop having an aperture extending generally horizontally therethrough, the aperture having a length extending generally perpendicularly to a radial plane passing through said each loop and axis, and wedge means extending through said loop aperture and engaging said bonnet on each side of said each loop to releasably secure said liner in place on said bonnet, said aperture being defined by an upper wall that is arcuate in the direction of the length of said aperture, said upper wall having a center of curvature that is above said loop, said wedge means including a wedge extending perpendicularly to said plane, and including an elongated contoured element having a longitudinally extending planar surface in engaging relation with said wedge and having an opposing longitudinally extending arcuate surface in mating engagement with said upper arcuate wall, said wedge being insertable from either side of said each loop with full surface bearing between said wedge and said contoured element and between said contoured element and said upper arcuate wall.

* * * * *